US005754989A

United States Patent [19]

Ludlow

[11] Patent Number: 5,754,989

[45] Date of Patent: May 26, 1998

[54] PLUMBING AND SHELL SYSTEM FOR SPA

[76] Inventor: David Jon Ludlow, 3616 Elmwood St., Salt Lake City, Utah 84106

[21] Appl. No.: 677,840

[22] Filed: Jul. 10, 1996

[51] Int. Cl.[6] ..... A61H 33/04

[52] U.S. Cl. ..... 4/541.6; 4/541.1

[58] Field of Search ..... 4/541.1–541.6, 4/286

[56] References Cited

U.S. PATENT DOCUMENTS

| | | | |
|---|---|---|---|
| 4,339,833 | 7/1982 | Mandell | 4/541.4 X |
| 4,533,476 | 8/1985 | Watkins | 4/541.1 X |
| 4,658,449 | 4/1987 | Martin | 4/286 X |
| 4,953,240 | 9/1990 | Gardenier | 4/541.3 |
| 5,328,602 | 7/1994 | Brooks | 4/541.1 X |
| 5,418,984 | 5/1995 | Livingston | 4/541.1 |

FOREIGN PATENT DOCUMENTS

| | | | |
|---|---|---|---|
| 3634115 | 4/1988 | Germany | 4/541.5 |

*Primary Examiner*—Charles E. Phillips
*Attorney, Agent, or Firm*—James L. Sonntag

[57] ABSTRACT

A water distribution system for a spa is disclosed that comprises at least one channel around at least a portion of the peripheral edge of the shell, a water feed pipe in communication with a source of pressurized water disposed within the channel with a penetration of the shell by the water feed pipe at an end of the channel, a pod depression in the containment of the shell constructed and configured such that the channel is interrupted by the depression and the water feed pipe continues through the pod, a jet water outlet feed on the water feed pipe at the pod that is constructed and configured to provide at least one water feed outlet for a jet, and at least one water jet with water communication with the water feed outlet.

23 Claims, 7 Drawing Sheets

PLUMBING AND SHELL SYSTEM FOR SPA

FIELD OF THE INVENTION

This invention relates to the construction of spas or hot tubs.

BACKGROUND OF THE INVENTION

Bathing appliances in the nature of spas, or so-called hot tubs, have become commercially successful. These spas are typically constructed as a molded shell to form a water containment, with seats, footwells, platforms for reclining, and the like molded into the shape of the shell. The shell is usually molded from plastic or fiberglass or a composite thereof. A pump or pumps usually placed in a chamber under the shell draw water from the water containment and reinject the water into the containment through a variety of nozzles, hydrotherapy jets, and the like. The jets are usually mounted in the shell under the water line, and are designed to provide a comforting or therapeutic effect to a person in the spa. The jets are usually mounted by making a hole in the shell, and fixing the jet in the hole by a use of seals, adhesives, welding compounds, or a combination thereof. Water supply lines from the pumps to the jets are usually flexible tubing or rigid PVC tubing. After the jets and tubing are in place, an expandable foaming polymeric material is blown into the empty spaces to provide thermal and sound insulation. This construction system has been used widely and successfully, and is currently almost universally used.

However, there are continuing problems in the prevention of leaks in these spas and in the repair of leaks. Jets are almost always mounted in a hole under the water-line of the shell, which presents the possibility of leaks around the jets. Plastic welding, sealants and various sealing systems have been used to prevent leaks, but with the relatively large number of jets being used in present construction, the development of leaks at or around the jets is a frequent occurrence. Leaks also occur in the water supply lines, at welded joints where they are joined to the jets, and in other fittings. In addition, poor workmanship and defects in the materials cause leaks. Over time, the thrust or line pressure and the variation in line pressure from the pumps being turned on and off, tend to flex joints and seals and eventually open them up to form leaks. This has become a particular problem in the plumbing system used currently for most new spas, where flexible tubing lines to the various jets are stretched over barbed fittings on a manifold. The fluctuating pressure over a period of time tends to expand the flexible tubing and loosen the seal at the barbs. In addition, the clear vinyl tubing frequently used for supply lines between the jets and the manifolds frequently deteriorates from reaction with components in the water, such as chlorine or ozone oxidants, or other water additives. This greatly aggravates the problems as these lines are usually buried in foam.

The second serious problem is the detection of the source of leaks and their repair. The tubing, plumbing, jet and manifold connections, and the like, are usually buried in the foam covering the underside of the shell. To access a leak, the spa must be emptied and turned on its side. The foam must then be dug out to access the leaking jets or connections. Since, the leak cannot be directly observed it must often be diagnosed by tracing the track of the leak through wet foam (sometimes by using a dye in the water), or by observing other signs of leakage or water damage. This is an imprecise process and can result in unnecessary misdiagnosed or precautionary repairs. Furthermore, even with the foam removed, the complexity of the jet and plumbing designs creates a "spaghetti bowl" of tubing which can render access to a particular jet or joint nearly impossible.

Once the leak site is determined, removal and replacement of the defective component often involves cutting out and removing the welds or seals of the part with the shell, and then replacing them with new parts. For example, to replace a jet, the old jet must often be cut out and removed from the water connection. The old sealant materials must be scraped off from surfaces around the hole in the shell. The new jet, must then be resealed to the shell hole, and the water connections resealed rewelded, or spliced into place.

This labor intensive procedure not only occurs for leak repair, but is also often required for replacing a defective non-leaking jet, or for replacing a jet with a different type of jet. Thus, a user is essentially precluded from upgrading his spa with new jets of a different type or a different size, since jet replacement is usually difficult or impossible.

When a leak does occur, it is important that the leak be repaired soon, for a leak can lead to further damage of spa components, and to the surroundings of the spa. In addition, when leaking water soaks into and saturates the insulating foam, the water substantially reduces the R-value of the foam. This can substantially increase the energy costs for heating the water.

In summary, the present systems are prone to leaks at nearly inaccessible, difficult to reach locations. The leaks are often difficult to diagnose, and the repair is costly and labor intensive. The difficultly in replacing jets precludes any real flexibility on the part of the spa owner in adapting the spa and its jet designs and types to his own individual interests.

OBJECTS OF THE INVENTION

It is, therefore, an object of the invention to provide a spa system in which leaks in the shell and the plumbing are minimized, or rendered harmless.

It is also an object of the invention to provide a jet and plumbing system for a spa which is easy to repair and to modify to fit individual tastes.

It is also an object of the invention to provide a spa that does not require labor intensive procedures and spa downtime to repair leaks, replace or upgrade jets, or make other modifications or repairs to the water supply and jet system.

Further objects of the invention will become evident in the description below.

SUMMARY OF THE INVENTION

In brief summary, the present invention overcomes or substantially alleviates the aforesaid problems of prior-art systems. Rather than penetrating the shell at each point in which water is introduced through jets or withdrawn through a drain, there is a distribution system within the containment that allows withdrawal or introduction of water from a plurality of points but with one shell penetration. The distribution system is contained in a hollow which is formed into the spa shell as a pod or channel. The hollow is covered to present a smooth surface inside the containment. Accordingly, unsightly and unsafe plumbing and the like are not exposed to the bather. The hollows are appropriately shaped into the form of channels or pods in the spa shell to enclose piping, nozzles, or the like. For a water distribution system for introducing water into the spa, a water distribution line penetrates the spa shell at only one point and the water supply lines are contained in the channels, which lead to multiple jets that are mounted on covers that cover or enclose the pods.

In a preferred embodiment of the invention, the water distribution system for a spa has a channel extending around at least a portion of the peripheral edge of the shell of the spa. A water feed line extends along the bottom of the channel, penetrating the shell only at one or both ends of the channel above the standard fill line or operating water level of the spa. The water feed line is connected to a pressurized water source, usually the recirculation pump of the spa. At preselected points along the channel, a depression or jet pod is molded into the shell, interrupting the channel with the peripheral water feed line extending across the pod. At the pod, the peripheral feed line is provided with suitable water outlets, such as through a manifold construction, to provide water supply to jets in the pod. The water outlets are connected to the jets by suitable means, such as flexible jet feed lines, which are preferably mounted upon a jet plate or cover that covers the pod depression and provides an enclosure for the manifold and jet supply lines.

The manifold preferably comprises union connectors that permit removal of the manifold from the supply line, along with associated jets and lines supplying the jets. This permits easy replacement, upgrade, and repair of the jets.

In the present invention, the number of penetrations of the shell is kept to a minimum, which minimizes the occurrence of leaks through the shell. Most of the water supply circuit, particularly vulnerable connections and manifolds to jets, are on the containment side of the shell, so that if there is a leak, water will flow harmlessly into the containment. This contrasts with prior-art systems where there are several penetrations, at least one for each jet, and the water supply system is mostly buried in foam on the underside of the shell.

The benefit of the present invention, is the low occurrence of leaks, the elimination of the possibility of damage for most leaks that may occur, and the ease of repairing, modifying and upgrading the system. There is only one shell penetration above the water line required for each water supply circuit. Leaks that occur in the supply lines will flow into the channel or pod, and eventually into the containment. If a repair is required, the water lines are accessible without having to empty the spa, tip up the spa, and dig through the foam.

DETAILED DESCRIPTION OF THE INVENTION

Figure 1:
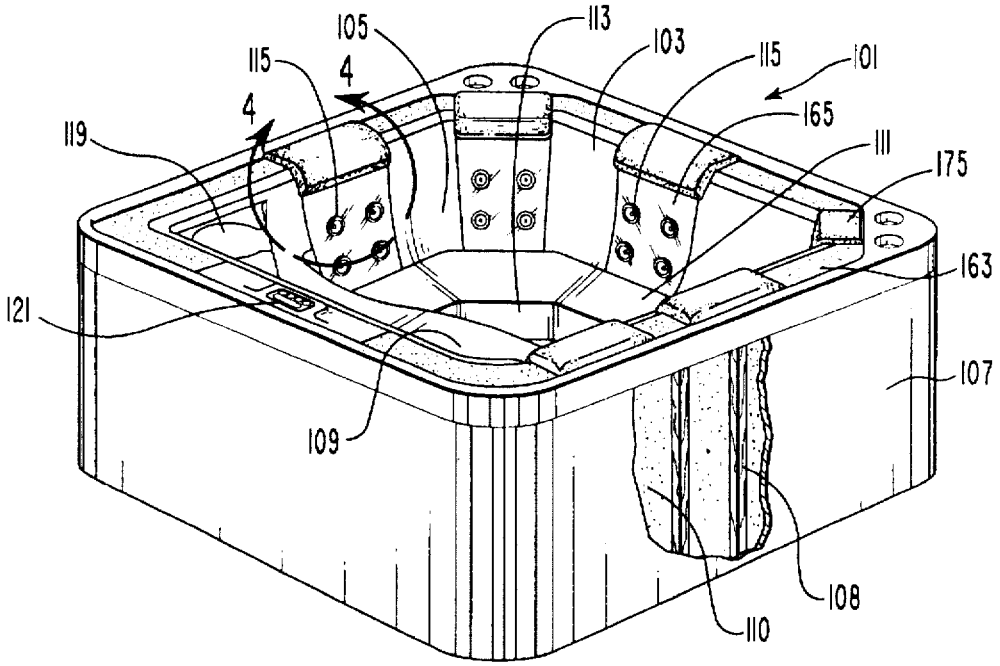
FIG. 1 is a perspective view of a spa of the invention.

FIG. 1 is a perspective view of a spa of the invention 101 comprising a shell 103 to provide a containment 105 for water, and a skirt cabinet 107 that conceals the support structure 108 and insulating foam 110 for the shell, and the pumping, filtration and circulation hardware. The spa 101 illustrated is approximately 8 feet square and 3 feet high.

Figure 2:
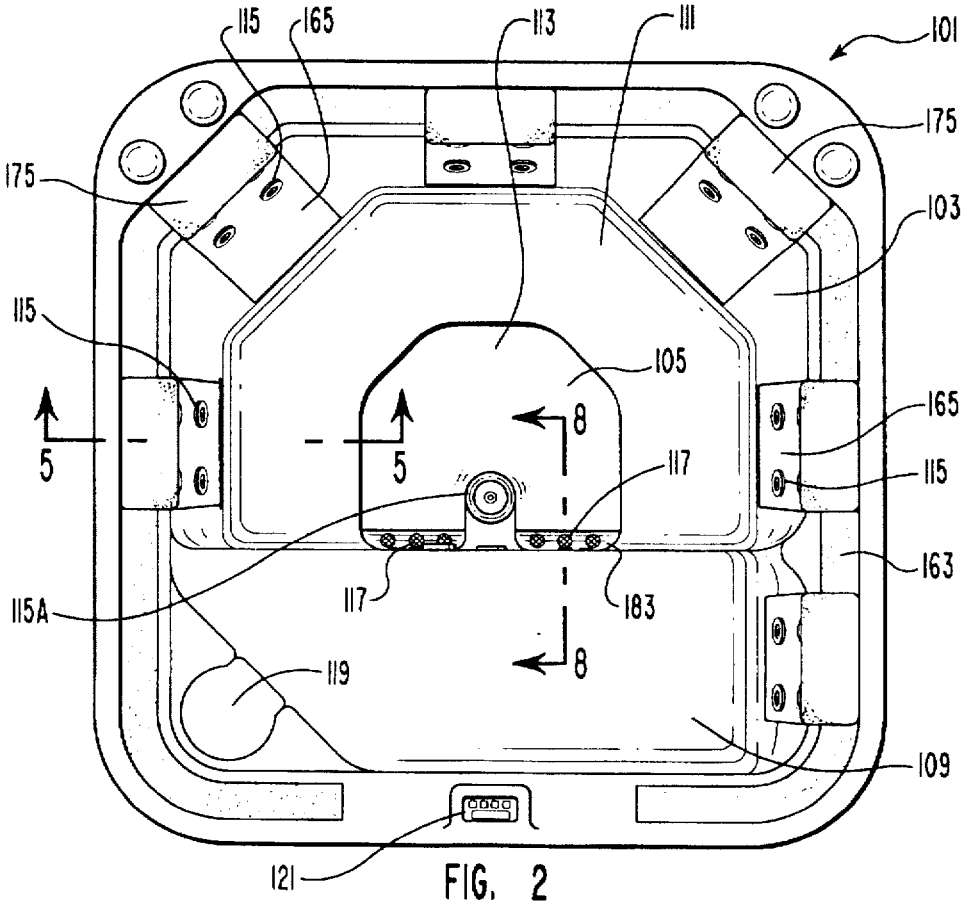
FIG. 2 is a top view of the spa of FIG. 1.

With reference also to FIG. 2, which is a top view of the spa of FIG. 1, the shell is configured to comprise a lounging platform 109, a seating platform 111, and a footwell 113. As more fully described later, the spa includes jets 115 through which water is directed under pressure into the containment 105. Drains 117 are provided to withdraw water from the containment for recirculation to the jets 115. A cover 119 is provided for access to the filter, and a touch pad control 121 is used to control the various functions of the spa.

Figure 3:
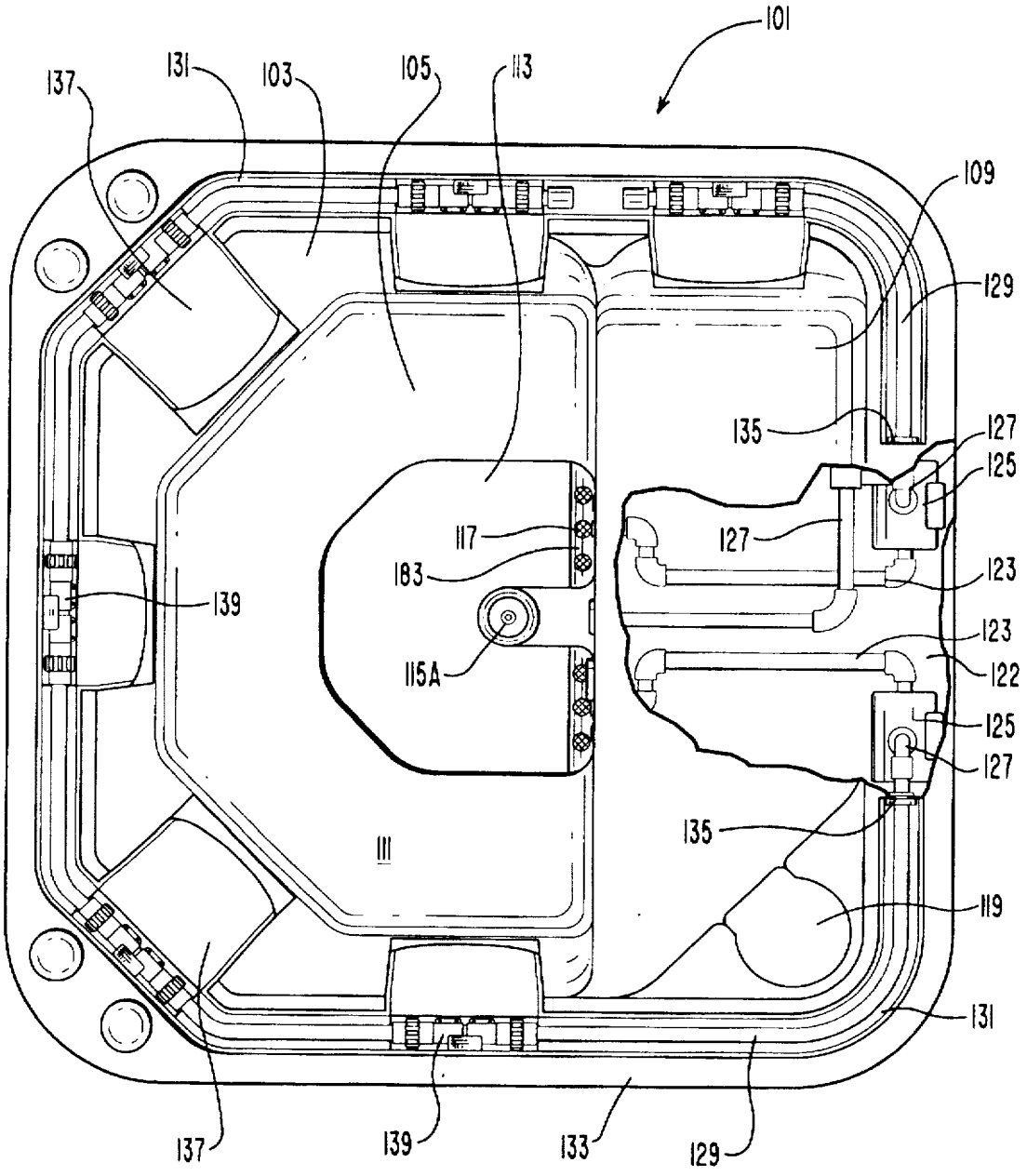
FIG. 3 is a view similar to FIG. 2, with a partial section and with covers removed to particularly show features of the water supply system of the spa.

With reference also to FIG. 3, which is a top view of the spa of FIG. 1 in partial cutaway showing the plumbing system of the spa, water is withdrawn from the containment through drains 117 and drain lines 123 by pumps 125. Alternately, the water may be merely drawn out by gravity. A switching valve (not shown) may be provided to allow emptying of the containment by using the pumps. Pressurized water from the pumps 125 is directed through pump outlet lines 127 into peripheral supply lines 129. The peripheral supply lines 129 are disposed in a channel or channels 131 near the peripheral edge 133 of the shell, penetrating the shell 103 at a channel dam or dams 135 at an end of the channel 131. The channel 131 is interrupted at spaced, predetermined locations by a pod 137, which, as described further below, provides a containment and support for the jets 115. The pods 137 interrupt the channel 131 in such a manner to provide communication of the channel 131 with the containment 105, i.e., such that water in the channel 131 flows into the containment 105. In normal operation, there is no water in the channel 131 as the channel is constructed above the full or operating water line 195. The channel is constructed such that any water that may leak into the channel will eventually flow into the containment. This may be accomplished by providing water flow paths thought the channels into the pods as illustrated. Alternately, the peripheral channels may be in or at the top of the side walls or in the floor of the shell so that water flows directly into the containment from the channel. If at the top of the side wall, the channel may then be covered with a quarter-round cover to conceal the supply lines in the channel.

In an alternate construction, the channel may extend from the penetration of the channel through the shell and then travel, at least in part, under the water line. In such a construction, the channels would be in the form of grooves in the shell wall, with covers to enclose the water supply lines in the groove and present a generally continuous surface with the shell. This construction may be adaptable for jets, such as foot thrust jets, that are mounted near or in the bottom of the shell. The shell may have a full or partial false bottom, where a channel or channels with a water line or lines expand at the bottom into a jet pod hollow. A cover over the jet pod provides a false bottom surface and mount for bottom mounted jets. Further channels may extend from the bottom pods to additional bottom pods or up the sides of the shell to side mounted jets. In a like manner, additional channels extending from side jet pods, from the peripheral channel, or directly from the penetration may be used in place of or as a supplement to the peripheral channel.

Basically, the invention derives its advantages from 1) having only a single penetration for a multiple set of jets, and 2) having the supply lines in covered channels, hollows or chambers that are disposed such that water will drain or flow into the containment. If the hollow is under the water-line 195 the hollow is merely in communication with the containment such that water flows freely between the hollow and the containment. If the hollow is above the water line, the hollow is constructed such that water flows into an adjacent hollow, channel, pod, or chamber, or directly into the containment. The penetration is preferably above the water line, but may also be below the water line. Since the line at the shell penetration will rarely require replacement or repair, the line and the shell can be permanently sealed at the penetration by welding or the like.

Figure 4:
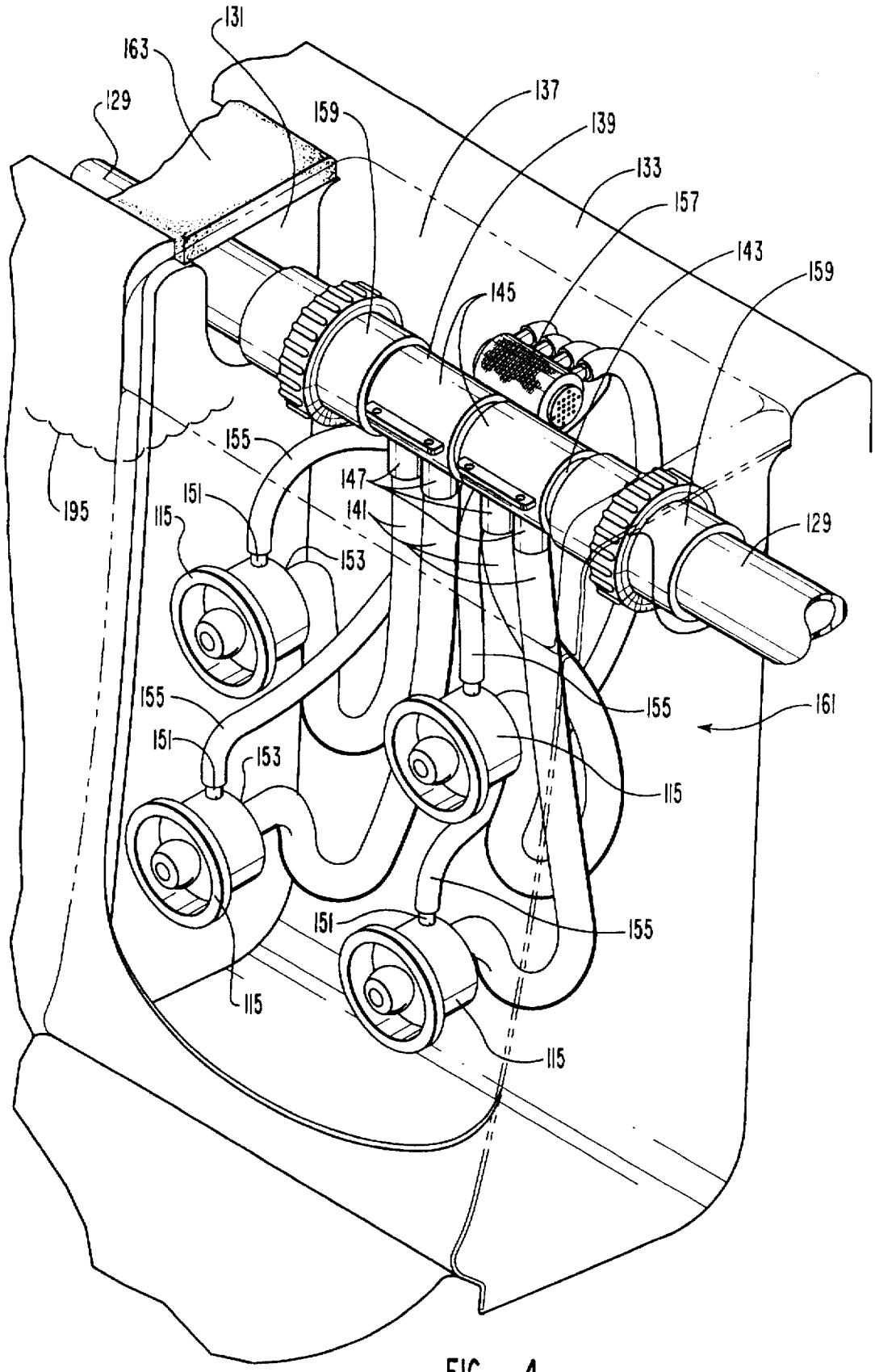
FIG. 4 is a detail view at 4—4 in FIG. 1 of a pod, showing connections to the jets.

Referring also the FIG. 4, the peripheral supply line 129 is supported in the channel 131. The channel is interrupted by a pod 137 which is molded into the shell 103 as a cavity or depression. The peripheral supply line 129 travels unsupported through the upper portion of the pod 137, and at this location includes a manifold 139 that provides one or more ports 147 for jet supply lines 141 that feed one or more jets 115 mounted in the pod. The manifold 139 and the jet supply lines 141 may be of any suitable construction. The illustrated manifold is formed with a pipe section 143 from the same pipe material as the peripheral supply line with a sleeve 145 covering the pipe section 143. The sleeve 145 is molded with one or more ports 147 for connection to flexible jet supply lines 141 that supply pressurized water to jets 115. The jets 115 illustrated are of conventional construction and comprise an air inlet 151 and water inlet 153. The jet 115 mixes air and water that are directed into a single pressurized steam into the containment. In the figure, the water and air inlets 153, 151 are shown on the side and the back of the jet, respectively, but the jet may also be configured differently, for example with both ports on the side, or back. The air inlet 151 of each jet 115 is connected via air supply lines 155 to an air intake manifold/filter 157. On either side of the water supply manifold 139 are union connectors 159 which allow disconnection and removal of the assembly 161 of the manifold 139, associated jets 115, and jet and air supply lines 141, 155, and air intake manifold 157. This allows easy replacement, maintenance, upgrading or repair of any components of the manifold/jet assembly 161.

The present invention is particularly beneficial because of the response to leaks in the system. If there is a water leak of the peripheral supply line 129 where it extends through the channel 131, the water merely flows along the channel into an adjacent pod 137. If there is any leak associated with the manifold 139, jet supply lines 141, or jets 115, the water merely flows into the pod 137, which is essentially an extension with the water containment 105 of the shell 103. Thus, unless a leak at any of these points is severe, the leak will probably not even be detected, and will not materially compromise the function of the spa or jets. Thus, small leaks can continue without any harm to the spa system or knowledge to the user. In the case of a serious leak, such as a catastrophic failure of a jet or peripheral supply line, the water will merely flow into the channel or pod and eventually into the containment, and will not leak into and saturate the foam or harm other components of the spa.

To repair a leak, the peripheral supply lines are easily accessed in the channels, and the manifolds and jet supply lines are accessed from the containment in the pods. For any one water supply circuit, there is only one penetration of the shell where the supply line goes through the shell at the dam. At this penetration, there is a seal between the peripheral supply line and the shell to prevent leaks through the shell. Since the dam is usually above the water level of the containment, a failure of this seal may not even result in the leaking of water through the shell. Any water in the channel quickly flows out and into the pods, so there will be little water accumulation, if any, against the dam that might otherwise flow through a failed seal at the penetration. If a repair is required, this penetration is preferably adjacent to the open chamber containing the pumping and filtering hardware. Therefore, access does not require removal of a thick layer of foam from underneath the spa, rather access is easily achieved though the open pump chamber.

The channels may be covered for appearances by a cover 163. If access to the channel is required for repair of the peripheral supply line 129 or for cleaning, the cover 163 is merely removed. Thus, essentially the entire water supply circuit is accessible, without having to remove the water in the spa, opening the cabinet or tipping the spa up. The pumps and pump outlet lines are accessible though the open pump chamber, which may or may be not filled with foam. The peripheral supply lines are accessible through the channels, and the manifolds, jet supply lines, and jets are accessible through the pods.

This contrasts with spas of conventional constructions with conventionally mounted jets. In conventional spas, a jet is sealed directly in an under-water-line penetration of the shell with water supply lines which are directed from the pump, travelling under the shell, to the jet. For any jet not directly adjacent to the pump chamber where the pumps are housed, the lines are buried in insulating foam for most of their length. In prior-art spas, there is such a shell penetration at each jet, and the associated supply lines and manifolds are outside of the shell containment, mostly buried in the foam insulation. When there is a leak at a jet, supply line, or manifold, the water usually flows, not into the spa containment, but through insulating foam under shell, and onto the floor. A repair requires the spa to be emptied, and the leak found and made accessible by tipping the spa on its side or top, and digging out the insulating foam near the leak.

Accessing the jets by digging out the foam is difficult enough, but it is aggravated by the fact that multiple jet supply lines are required, one for each of the many jets that penetrate the shell. This often results in a spaghetti like nest of tubes and lines, which causes difficulty in finding a line that is leaking and impairs physical access to a leaking jet. Diagnosis of the leak can also be difficult. Since the spa must be emptied before a repair, and the foam obscuring the leak removed, direct observation of the leak is not possible. Since the leak cannot be observed directly, location of the leak must be deduced by indirect methods, such as the pattern of water in the foam and other evidence of the flow path of the water. Thus, a repair often requires the removal of foam just to inspect a jet or supply line for secondary signs of leakage or a failure, which then is repeated until the actual leak is found. The result is unnecessary labor to access and inspect non-leaking components and frequently in unnecessary, precautionary repairs of non-leaking components. After the leak is repaired, the components must be allowed to dry, and new expandable foam applied, which also adds to the down time of the spa.

The present invention is also inherently subject to fewer leaks than the prior-art systems. In the present invention, each water supply circuit requires only one penetration of the shell, preferably above the water-line, to provide the water supply for many jets. This contrasts with the prior-art systems where there is an underwater penetration of the shell for each jet. Penetration sites of the shell are frequent sites for leakage through the shell, particularly where there is a penetration under the water line. Thus, in prior-art systems there are multiple under-water-line penetrations (one for each jet) of the shell for each water supply circuit, which in the present invention are replaced by one penetration.

Figure 5:
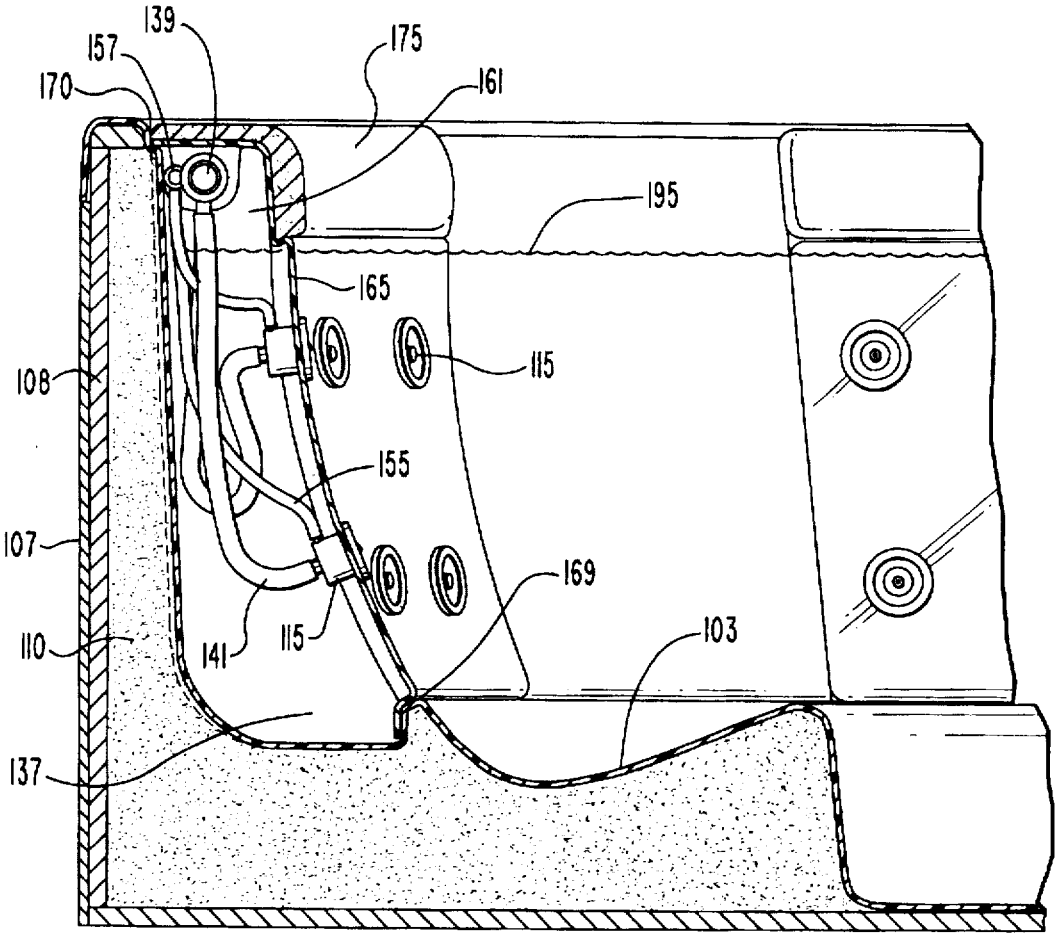
FIG. 5 is a cross-section of the pod in FIG. 4, through 5—5 in FIG. 2.

Referring to FIG. 5, shown is a cross-section of a pod through 5—5 in FIG. 2 showing the shell 103 and underlying foam 110. The jets 115 in the pod 137 are supported on a pod cover plate 165, which covers the cavity or depression forming the pod 137. The cover 165 is held in place by any appropriate means, such as that illustrated, a ridge 169 on the shell to engage the lower peripheral edge of the cover, and a shelf 170 at the top and front edge of the shell that supports the edges of the cover 165. Appropriate screws, clamps, clips or other fasteners (not shown) may be used to further secure the cover in place. The attachment of the cover to the shell is preferably non-sealing with respect to water to permit free passage of water between the jet pod and the major containment of the shell. Alternately the cover may have apertures for the flow of water. The cover preferably includes a cushion or pillow 175 at its top edge for supporting the head of a bather.

Figure 6A:
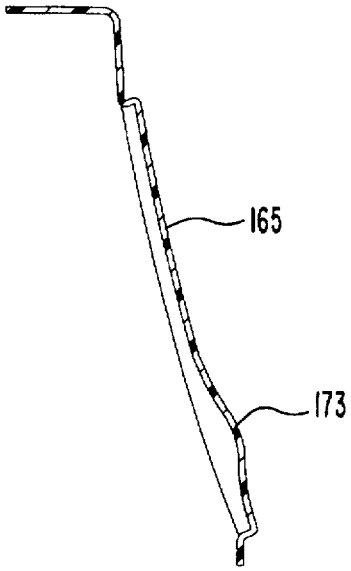
FIGS. 6A and 6B show alternate covers for the pod as in FIG. 5.
Figure 6B:
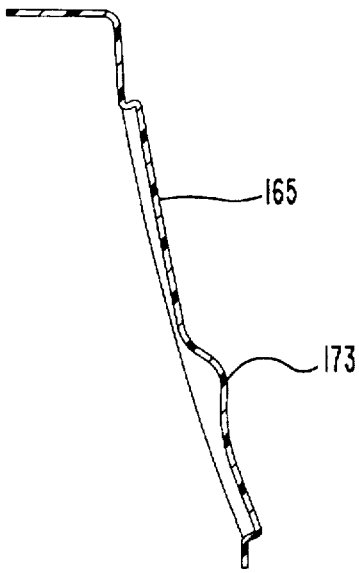

The cover 165 is preferably configured to provide a pleasing visual appearance and to provide a comfortable resting surface for the back of a bather. Accordingly, preferably the cover 165 also incorporates cushions 175, and the like for the comfort of the bather. The shell 103 and the cover 165 are configured so that there is a visual appearance of an essentially continuous surface. Since the manifold, and jet supply lines, etc., are covered in the pod by the cover, the only visible part is the jet outlet, and there are no projecting pipes or the like that would be unsightly or present a hazard. Visually speaking, essentially the only difference between the water containment of a spa of the invention and a prior art spa is the inconspicuous joints around the pod covers where they fit into the shell. As illustrated in FIGS. 6A and 6B, the cover 165 may also be optionally configured to provide ridges or contours 173 to provide decoration, or custom contours for lumbar back support.

The jet-pack 161, which is the assembly of a cover 165 and jets 115 with associated jet air and jet supply lines 155, 141 and manifold 139, is easily removed from the spa. By simply removing any cushion 175 and any screw or fasteners holding the cover 165 in place, and disconnecting the union connectors 159 associated with the manifold 139, the jet-pack 161 can be removed. Alternately, the jet supply lines can be removed from their respective connection to the manifold instead of disconnecting the union connectors. The jet-pack can then be easily repaired, modified or upgraded, and then returned to the spa by reversal of the steps. The jet-pack can also be replaced by a new jet-pack of the same or a different configuration. Thus, a spa can be customized and modified at will by replacing any of the jets, with only a minimum of training and in only a short amount of time.

In addition, the jets can be replaced without first emptying the spa. In contrast, the replacement of jets in prior-art spas is difficult and the replacement with a different type of jet in many cases is difficult or impossible. Replacement of the jet in a prior-art spa, whether for repair or to change the type, may involve the same laborious procedure involved in repairing leaks, i.e., tipping up the spa and removing the foam. In addition, a new jet must accommodate and be sealed into the existing penetration of the shell or the shell penetration must be modified. If the new jet requires a smaller penetration hole than the existing hole, it may not be practical or possible to seal the new jet into the shell penetration.

Figure 7A:
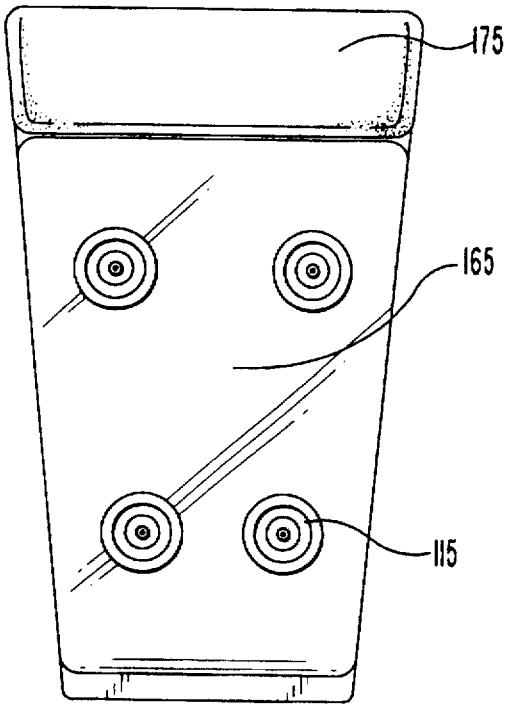
FIGS. 7A through 7H illustrate alternate jet cover configurations of the invention.

FIGS. 7A through 7H show jet and cover assemblies with different jet and cover configurations. As discussed above, these covers are interchangeable, and any of these or similar assemblies can be mounted in a pod. FIG. 7A shows a cover 165 with four conventional jets 115 directing pressurized water against the back of a bather leaning against the pod cover.

Figure 7B:
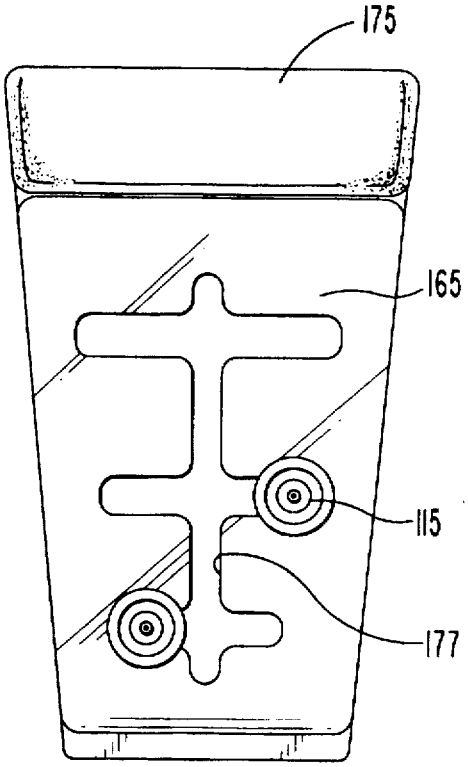

FIG. 7B shows the same conventional jets 115, but with slots 177. The edges of the slots engage grooves in the body of the jet to allow the jet to be moved to a new location by sliding it within the slot.

Figure 7C:
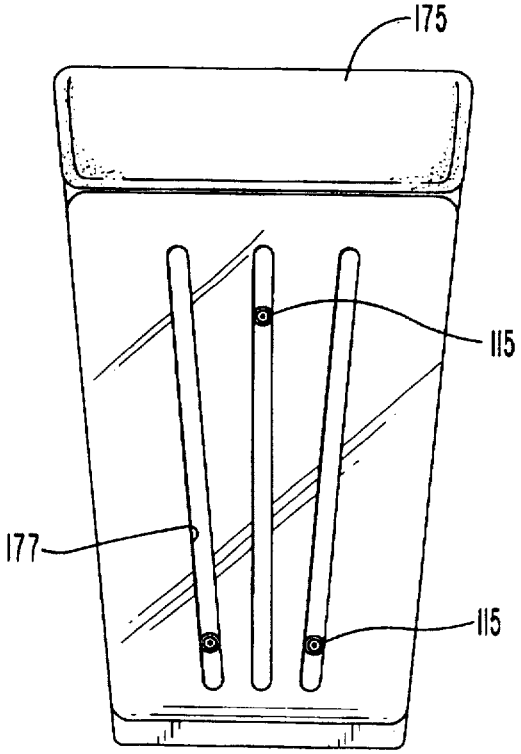

FIG. 7C also shows jets 115 that can be moved by sliding within slots 177, but the slots are vertical for vertical adjustment of the jets, and the jets are smaller. In general, the sliding jet/slot arrangements in FIGS. 7B and 7C can be modified for any suitable slot arrangement and any size of jet.

Figure 7D:
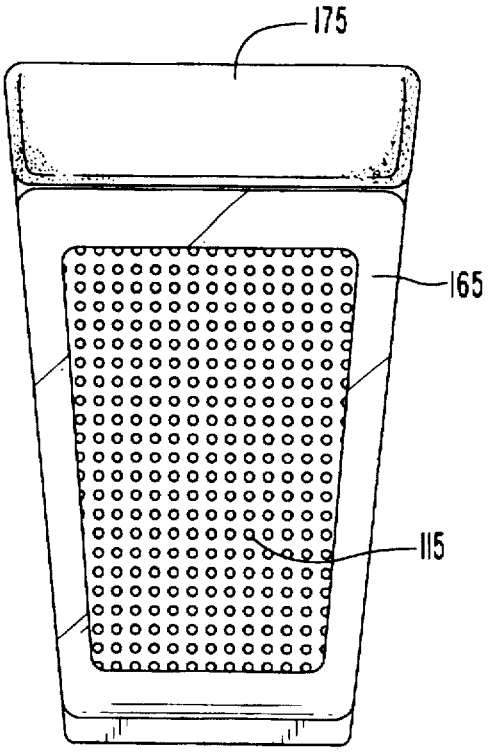

FIG. 7D shows an integral cover/jet assembly where water is directed through numerous holes in the face of the cover with a pressurized cannister behind the face.

Figure 7E:
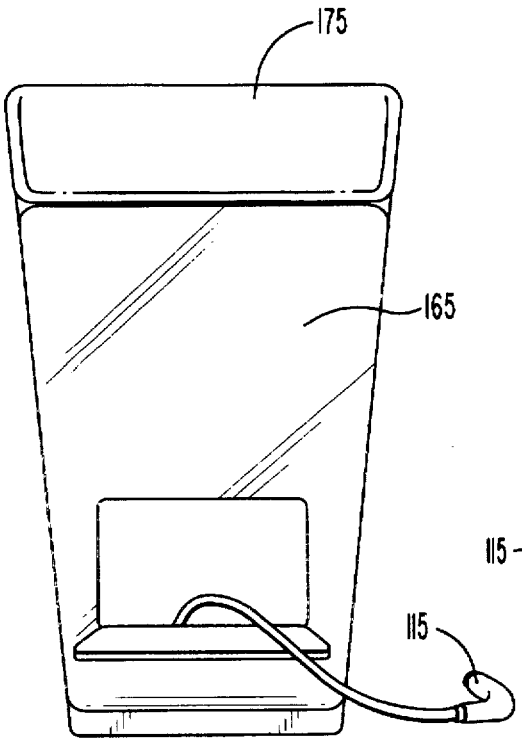

FIG. 7E shows a jet that is not mounted directly to the cover. The jet supply line is connected to a jet that merely lays unmounted in the pod containment. The user accesses the jet by opening a hinged panel, and pulling the jet though the passage. The jet supply line is of sufficient length to allow use of the jet as a wand, or the like.

Figure 7F:
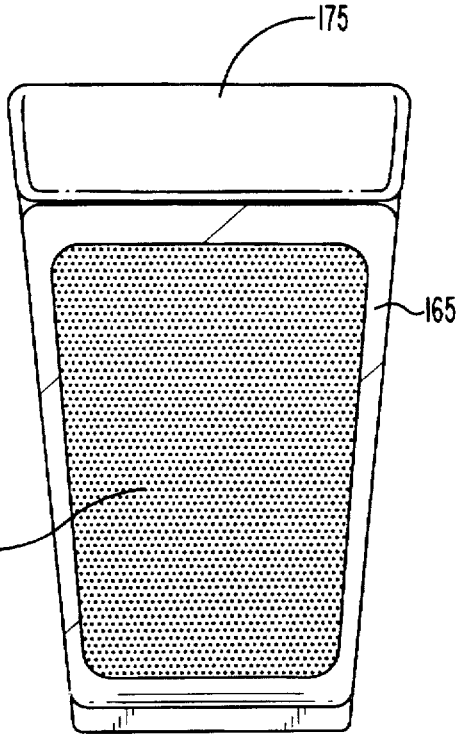

FIG. 7F illustrates a cover 165 wherein the jet 115 is in the form of a foam pad through which pressurized water with air is directed out onto the back of the bather over the entire surface of the pad. The cover may also incorporate a vibrator that is powered by the pressure or flow of the water.

Figure 7G:
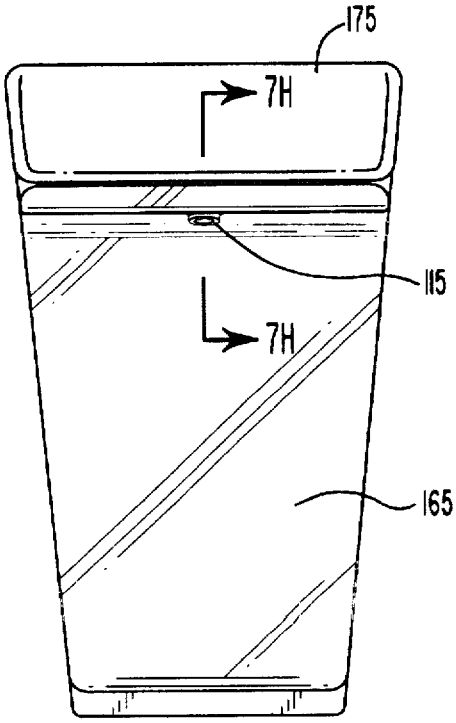
Figure 7H:
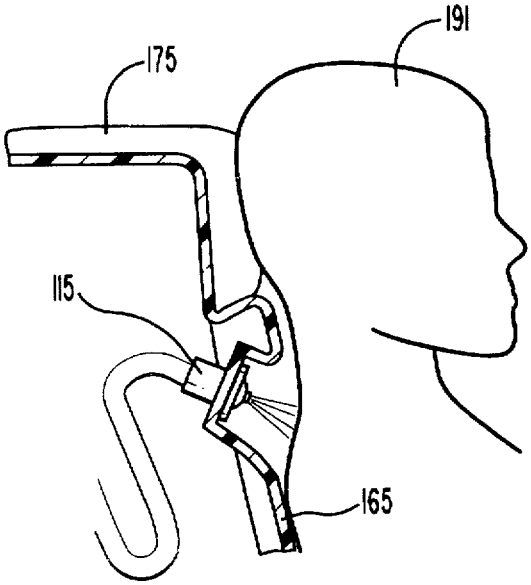

FIGS. 7G and 7H illustrate a back massaging system wherein a jet or jets 115 are placed above the shoulder level of a bather to direct water down upon the neck and upper back of the bather 191. This configuration particularly illustrates the versatility of the invention. Because the cover is detachable, it can be vacuum formed with an undercut for an above-water-line jet to be angled down to prevent water splash from the spa. In conventional spa construction, the undercut would have to be formed in the spa shell. Using conventional molding techniques this would be impossible as it would not permit removal of the shell from the mold. Thus, in conventional spa construction, a downwardly directed jet would require a specialized multi-piece mold, or the like, which is difficult and expensive.

Each of the covers illustrated in FIGS. 7A to 7H preferably includes a cushion or pillow at the top edge for supporting the head of a bather as he leans against the cover.

The invention may be applied for every jet in a spa, or be selectively applied to only certain jets to create a hybrid system with conventional jets and jets in jet packs according to the invention. For example, it may be more practical to mount jets in the floor, (such as the foot thruster 115A in FIG. 3) in the conventional manner. Even with such a mixed configuration, the penetrations of the shell have been materially reduced and thus the inherent possibility of leaks reduced. In addition, the plumbing has been greatly simplified. Any conventionally mounted jets with shell penetrations and foam buried water supply lines can be mounted individually so access is not impaired by a confusion of supply lines for adjacent jets. In addition, the spa can be designed so that jets with shell penetrations are close to the pump chamber, requiring a minimum of water lines that are buried in foam under the shell. Even with a hybrid construction it is possible to have no water lines buried in foam.

Alternately, as discussed above, a jet supply system with a single shell penetration and with supply lines in covered channels, chambers or hollows in the side or bottom of the shell, the bottom, or under a false floor can be used to supply jets at any point within the shell. Preferably the penetration is always above the water line, but it is contemplated that a shell penetration may be below the water line. In a below water-line penetration, the water line at the penetration can be securely welded and reinforced to protect against leakage. This contrasts with conventional designs where under-water line penetrations for jets are usually sealed with silicon sealants to allow subsequent removal of the jet for a repair. In the present invention, since the only penetrations are for water supply lines which rarely require repair or replacement, the penetrating lines can be permanently welded to the shell.

Figure 8:
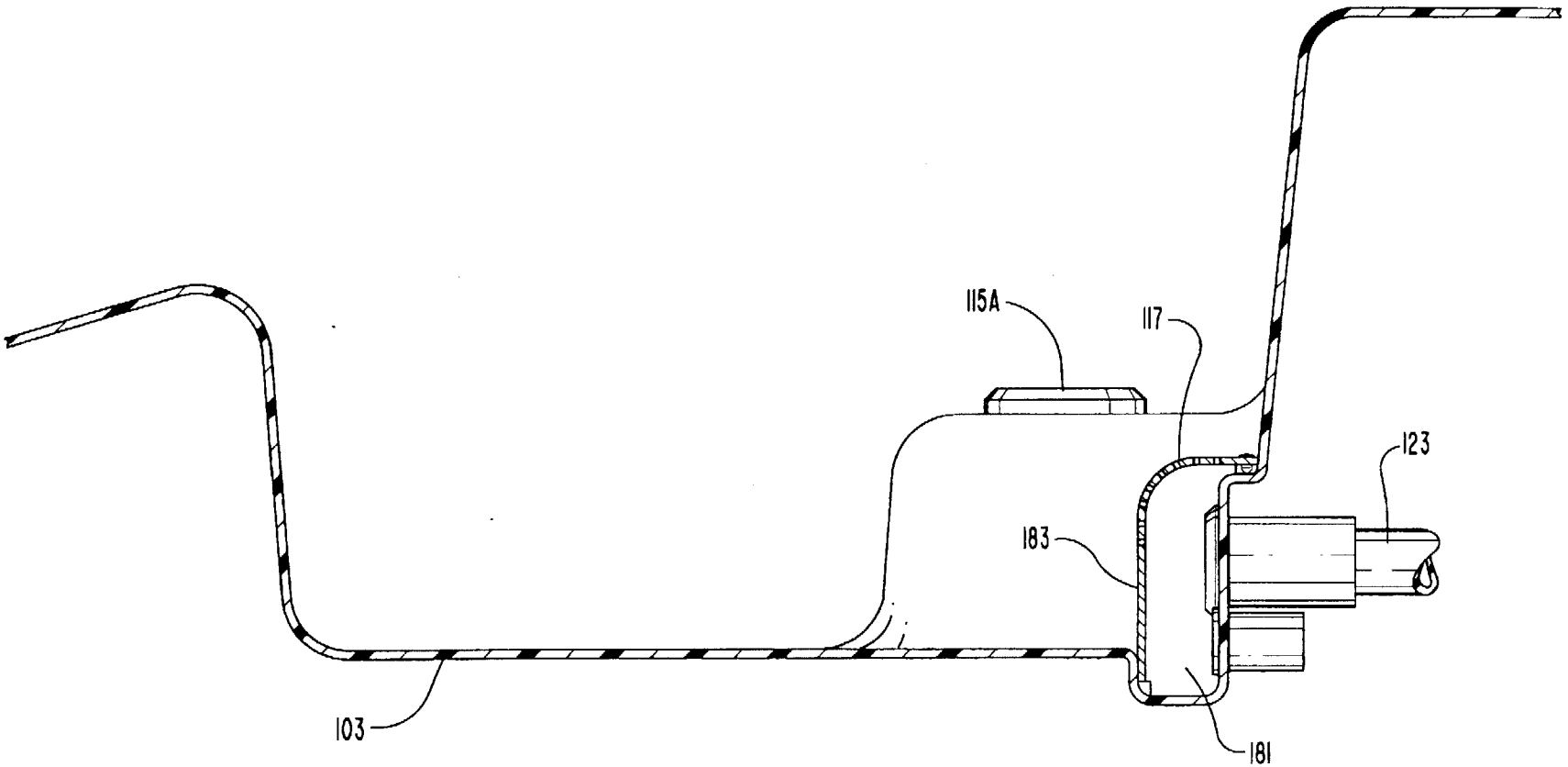
FIG. 8 is a cross-section through 8—8 in FIG. 2, showing a drain system of the invention.

FIG. 8, illustrates an application of the invention to a drain in a spa shell. In conventional spas, the suction line to the pump is now required for safety reasons to have a plurality of redundant drain openings into the spa containment. With only one opening, the suction pressure at the opening has been found to be dangerous, in that it is sufficient to hold a child underwater by the hair, or suck out an eye of an overly curious child. A plurality of openings are required such that if an opening is blocked by a body part, hair, etc., there is sufficient flow from other drains to essentially eliminate any suction at the blocked opening. However, increasing the penetrations to create redundant drain openings increases the probability of leaks through the shell. In the system illustrated in FIG. 8, (see also FIG. 3) each drain penetrates the shell at one point. Each point of penetration is recessed into a drain well 181, which is covered by well cover 183. Each drain well extends along a bottom edge of the footwell of the containment. Each well cover is perforated, as a screen, or has multiple apertures or drain openings for water passage. The effect is to spread the draining water over the entire surface or over several inlets in the well covers. Thus, there is drain opening redundancy for each drain line. Even though there is only one penetration of the shell by each drain line, the drain flow of each penetration is distributed over the surface of a wide well cover.

A filter of suitable design (under filter cover 119) is provided to filter drained water before it enters the pump. The pump outlet lines, peripheral supply lines, and jet supply lines may be of any suitable tubing or piping, such as the conventional rigid and flexible lines, e.g., PVC piping and vinyl tubing used in spa construction. The manifolds may be of conventional design. They may be assembled from rigid piping or may be molded with suitable outlet ports. The jet water supply lines and air supply lines (if required) are preferably flexible tube materials conventionally used to ease installation and removal of the cover and the manifold. The attachment of the jet water supply lines to the ports of the manifold may be by any suitable means, such as hose clamps, or by a molded barbed fitting at the manifold port. The shell, pod covers and the like are preferably manufactured from plastic or plastic/fiber composite materials by conventional methods for spa shells, such as by vacuum forming or injection molding. Any other suitable material for the shells and covers is contemplated, for example, molded or stamped metals, such as stainless steel. The water distribution systems of the invention may also include other components for filtering or treating the water, water softeners and conditioners, ozone generators, chlorinators, skimmers, thermostat water heaters, and the like.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. A water distribution system in a spa comprising a shell that provides a water containment for containing water up to an operating water level line, the water distribution system comprising;

at least one hollow molded into the shell that communicates with the containment such that any water in the hollow can flow into the containment, at least one jet disposed in the hollow to direct water into the containment, at least one jet supply line disposed in the hollow for at least a portion of its length and extending from a penetration of the shell above the water line of the containment to the at least one jet, the hollow comprising at least one pod with a channel extending from the shell penetration to the pod, at least one hollow cover configured and constructed to cover at least a portion of the at least one hollow and provide an enclosure for the at least one jet supply line.

2. The water distribution system of claim 1 wherein the at least one jet is mounted on the at least one hollow cover.

3. The water distribution system of claim 1 wherein the channel extends in part under the water line.

4. The water distribution system of claim 1 wherein the entire channel extends in its entirety above the water line.

5. The water distribution system of claim 1 wherein the at least one hollow comprises at least one pod with a channel extending from the shell penetration to the pod, and the at least one pod is covered by one of the at least one hollow covers with one of the at least one jets mounted on the hollow cover.

6. The water distribution system of claim 5 wherein there is a plurality of jets, a plurality of pod depressions interconnected by the at least one channel.

7. The water distribution system of claim 6 wherein there is a single penetration of the shell for distribution of water to a plurality of jets.

8. The water distribution system of claim 1 wherein there are at least two water distribution systems with separate penetrations of the shell and with separate jet supply lines disposed in a common hollow.

9. The water distribution system of claim 1 wherein there is at least two water distribution systems with separate penetrations of the shell and jet supply lines disposed in separate hollows.

10. A water distribution system in a spa comprising a molded shell to provide a water containment, the water distribution system comprising;

at least one channel that extends around at least a portion of the peripheral edge of the shell, a water feed pipe in communication with a source of pressurized water disposed within the channel with a penetration of the shell by the water feed pipe through the shell into the channel, at least one pod depression in the containment of the shell constructed and configured such that the channel is interrupted by the depression and the water feed pipe continues through the pod, at least one water jet with water communication with the water feed pipe disposed in the pod.

11. The water distribution system of claim 10 wherein the penetration of the shell is above an operating water level line and at a dam at an end of the channel.

12. The water distribution system of 10 wherein the water jet is mounted on a cover plate that covers the pod.

13. The water distribution system of claim 10 wherein water in the channel must flow to the pod depression to flow into the containment.

14. The water distribution system of claim 10 wherein water in the channel can flow directly into the containment.

15. The water distribution system of claim 10 wherein essentially all of the peripheral channel is above an operating water line of the containment.

16. The water distribution system of claim 10 wherein the portion of the peripheral channel is above an operating water line of the containment at the dam, and a portion of the channel extends below the water line.

17. The water distribution system of claim 16 wherein the portion of the channel below the full water line extends to a pod depression at or near the bottom of the shell, the pod depression having the at least one jet mounted in a cover over the pod depression that presents a generally continuous surface within the containment between the shell surface and the cover surface.

18. A water distribution system in a spa comprising a molded shell to provide a water containment, the water distribution system comprising;

at least one channel around at least a portion of the peripheral edge of the shell, a water feed line in communication with a source of pressurized water disposed along and within the channel with a penetration of the shell by the water feed line through a dam at an end of the channel at least one pod depression in the containment of the shell constructed and configured such that the channel is interrupted by the depression and the water feed line continues through the pod, a jet water outlet feed manifold on the water feed line near the pod that is constructed and configured to provide at least one water feed outlet for a jet, at least one water jet diposed in the pod with water communication with the water feed outlet.

19. The water distribution system of claim 18 wherein the water feed line at the manifold extends through the pod unsupported and comprises connections that permit removal of the manifold and replacement with the same manifold or a new manifold.

20. The water distribution system of claim 18 wherein the source of pressurized water is a pump that draws water from the containment through a drain.

21. The water distribution system of claim 18 wherein a cover covers the pod depression to form an enclosure for the water outlet feed.

22. The water distribution system of claim 21 wherein the cover provides a means for mounting the at least one jet, and provides an essentially continuous surface between the surface of shell in the containment and the surface of the cover.

23. The water distribution system of claim 18 wherein the manifold, with at least one jet feed line providing the water communication with the at least one jet, the jet and the cover are constructed as an assembly that can be removed as one unit and replaced by the same or like assembly.

* * * * *